United States Patent [19]

Jackovin

[11] 4,155,311

[45] May 22, 1979

[54] STACKABLE MODULAR SHELF APPARATUS

[75] Inventor: Gary B. Jackovin, Roscoe, Ill.

[73] Assignee: Belvedere Company, Inc., Belvidere, Ill.

[21] Appl. No.: 923,928

[22] Filed: Jul. 13, 1978

[51] Int. Cl.[2] ..... A47B 3/06

[52] U.S. Cl. ..... 108/111; 108/91; 211/199

[58] Field of Search ..... 108/111, 91; 211/198, 211/199, 194

[56] References Cited

U.S. PATENT DOCUMENTS

| | | | |
|---|---|---|---|
| 1,956,678 | 5/1934 | Hanson | 108/111 |
| 3,184,075 | 5/1965 | Cohen | 108/91 X |
| 3,908,564 | 9/1975 | Miller | 108/111 |
| 3,912,087 | 10/1975 | Zeischegg | 211/194 |

*Primary Examiner*—Francis K. Zugel
*Attorney, Agent, or Firm*—Morsbach & Pillote

[57] ABSTRACT

A stackable modular shelf apparatus including at least two vertically stackable frame modules and a multi-sided intermediate shelf, in which each frame module includes a plurality of generally rectangular individual frames corresponding to the number of sides on the intermediate shelf and arranged in upright planes along the sides of the shelf with the upright end members on adjacent ends of the frames juxtaposed adjacent the corners of the shelf and connected together by a plurality of connectors. One frame module is stacked on top of the other frame module and the shelf has a generally horizontal peripheral portion interposed between adjacent side members on the frames of the upper and lower frame modules. A plurality of second connectors are provided for interconnecting the upper and lower frame modules to each other and to the intermediate shelf and the second connectors each comprise a unitary resilient clip member having a U-shaped intermediate portion opening inwardly of the shelving apparatus to receive the peripheral portion of the shelf and semi-circular end portions opening outwardly of the shelf apparatus and dimensioned to receive the adjacent side horizontal members on the frames of the upper and lower frame modules.

8 Claims, 11 Drawing Figures

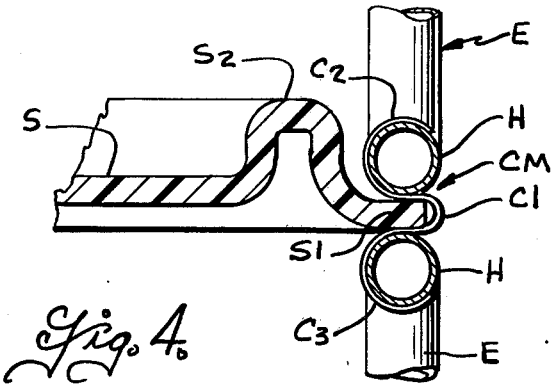
Fig. 4.
Fig. 3.
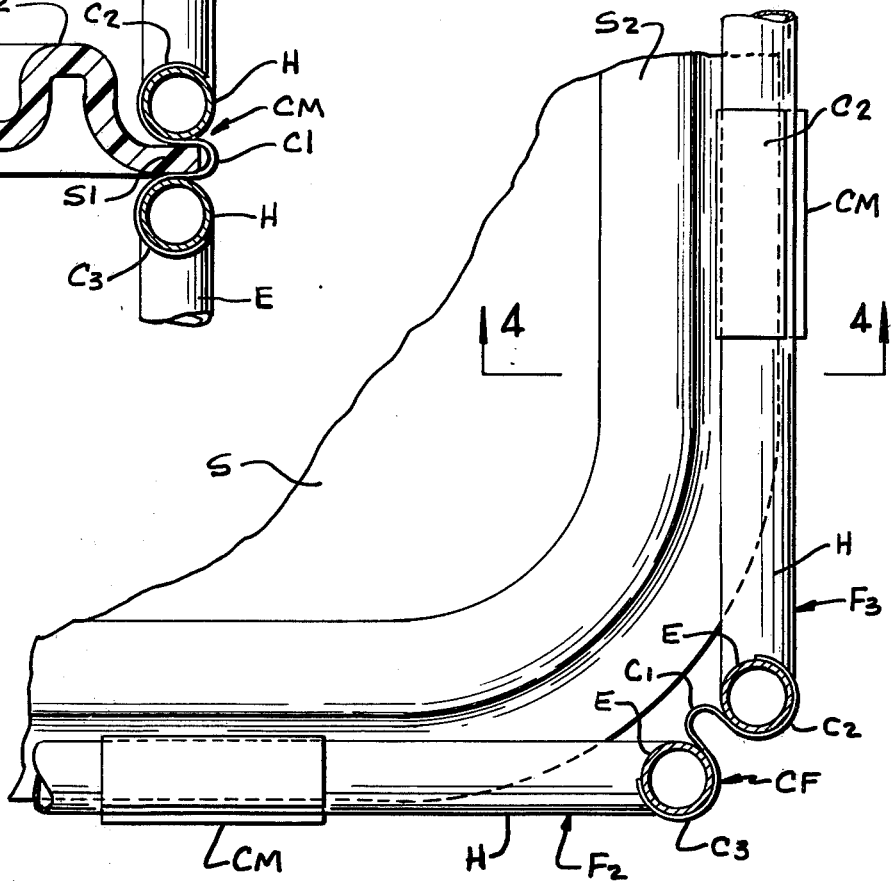
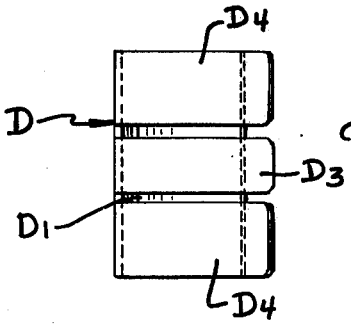
Fig. 6.
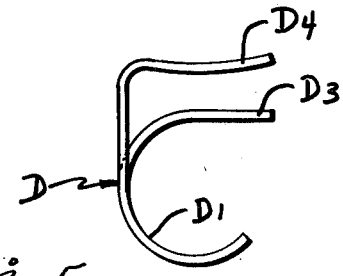
Fig. 5.
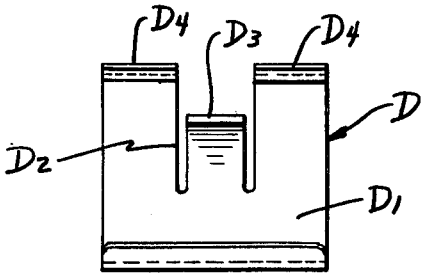
Fig. 7.

Fig. 8.
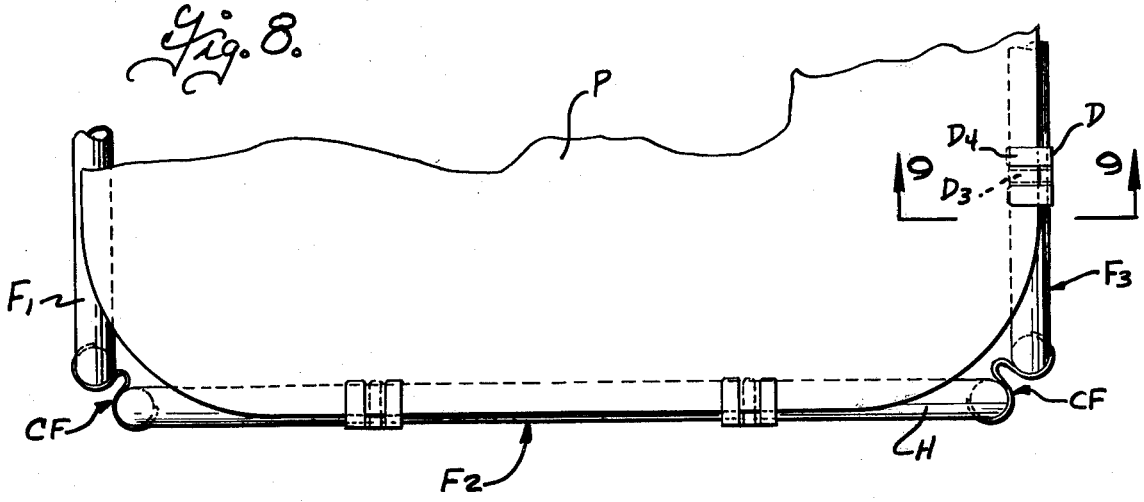
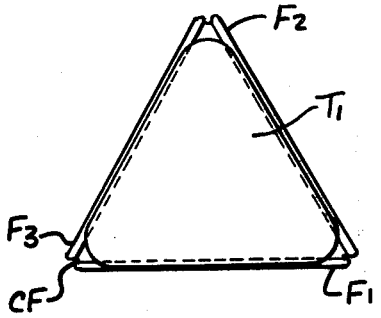
Fig. 10.
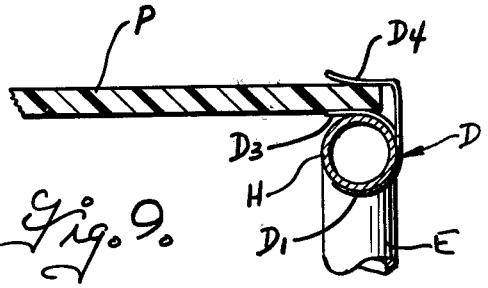
Fig. 9.
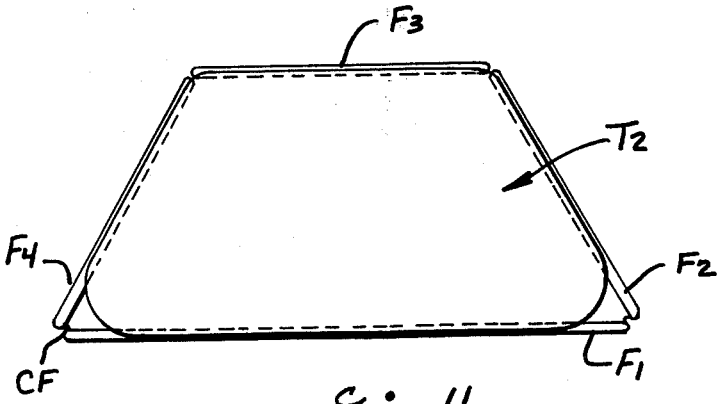
Fig. 11.

STACKABLE MODULAR SHELF APPARATUS

BACKGROUND OF THE INVENTION

It has heretofore been proposed, for example as shown in U.S. Pat. No. 3,908,564, to form a shelf apparatus in which a plurality of generally rectangular frames are hingedly interconnected at their upright portions to form a polygonal frame module, and to stack one or more such polygonal frame modules one on top of the other. In U.S. Pat. No. 3,908,564, a shelf is provided with a downwardly opening channel along its side edges which is dimensioned to receive adjacent horizontal members on the upper and lower frame modules, to interconnect the stacked frame assemblies. However, the contiguous horizontal members on the upper and lower frame shelf assemblies are received within and concealed by the downwardly opening channel on the shelf. Moreover, while the downwardly opening channel on the shelf inhibits relative horizontal movement between the upper and lower frame modules, it still permits vertical separation so that upper frame modules of the stacked shelf apparatus can be dislodged by tipping relative to the lower frame modules, if the upper frame modules are bumped or pushed laterally.

SUMMARY OF THE INVENTION

The present invention relates to stackable modular shelf apparatus of the type in which each frame module includes a plurality of individual generally rectangular frames arranged in a generally polygonal pattern and with the uprights on the ends of the adjacent frames are interconnected to form a polygonal frame module.

It is an object of the present invention to provide a stackable modular shelf apparatus having frame modules of the type described above and an improved arrangement for mounting an intermediate shelf between vertically stacked frame modules and for interconnecting the vertically stacked frame modules to each other and to the shelf to inhibit relative movement therebetween.

Another object of this invention is to provide a stackable modular shelf apparatus in accordance with the foregoing object and in which the intermediate shelf does not conceal portions of the frames on stacked frame modules.

These objects are attained in a shelving apparatus according to the present invention including at least two vertically stacked frame modules and at least one multisided intermediate shelf, each frame module including a number of individual frames corresponding to the number of sides on the intermediate shelf and each frame having a generally rectangular configuration with a pair of horizontal side members joined to a pair of upright end members at the corners of the frame, the frames of each frame module being arranged in upright planes along a respective side of the intermediate shelf with the upright end members on adjacent ends of the frames in each frame module juxtaposed adjacent the corners of the intermediate shelf, and a plurality of connectors engage the juxtaposed end members to interconnect the individual frames of each frame module. One frame module is stacked on top of the other frame module with the horizontal side members and the lower ends of the frames of the upper frame modules in juxtaposition with the upper side members of a respective frame on the lower frame module, the intermediate shelf having a generally horizontal peripheral portion interposed between the juxtaposed side members on the frames of the upper and lower frame modules, and a plurality of second connectors are provided for interconnecting the the upper and lower frame modules to each other and to the intermediate shelf. The second connectors each comprise a unitary resilient clip member having a pair of parallel semi-cylindrical end portions and an intermediate portion between the semi-cylindrical end portions and spacing the same apart a distance to at least equal to the thickness of the peripheral portion of the shelf and the intermediate portions of the second connectors extend across the outer edge of the intermediate shelf and the semi-cylindrical end portions of the second connectors are disposed at opposite sides of the peripheral portion of the shelf and embrace the juxtaposed side members to interconnect the frames on the upper and lower frame modules and to retain the intermediate shelf therebetween.

These, together with other objects, features and advantages of this invention will become more readily apparent from the following description taken in connection with the accompanying drawings wherein:

FIG. 3 is a fragmentary horizontal sectional view taken on the plane 3—3 of FIG. 1 and illustrating the parts on a larger scale;

FIG. 4 is a fragmentary vertical sectional view taken on the plane 4—4 of FIG. 3;

FIG. 5 is an end elevational view of a connector for connecting a top shelf or an end panel to the shelf apparatus;

FIG. 6 is an elevational view taken on the plane 6—6 of FIG. 5;

FIG. 7 is a rear elevational view taken on the plane 7—7 of FIG. 5;

FIG. 8 is a fragmentary top plan view illustrating a top shelf attached to the stacked modular shelf apparatus;

FIG. 9 is a fragmentary horizontal sectional view taken on the plane 9—9 of FIG. 8;

FIG. 10 is a plan view illustrating a modified shelf apparatus of generally triangular configuration; and FIG. 11 is a plan view of a further modified shelf apparatus having a trapezoidal configuration.

Figure 1:
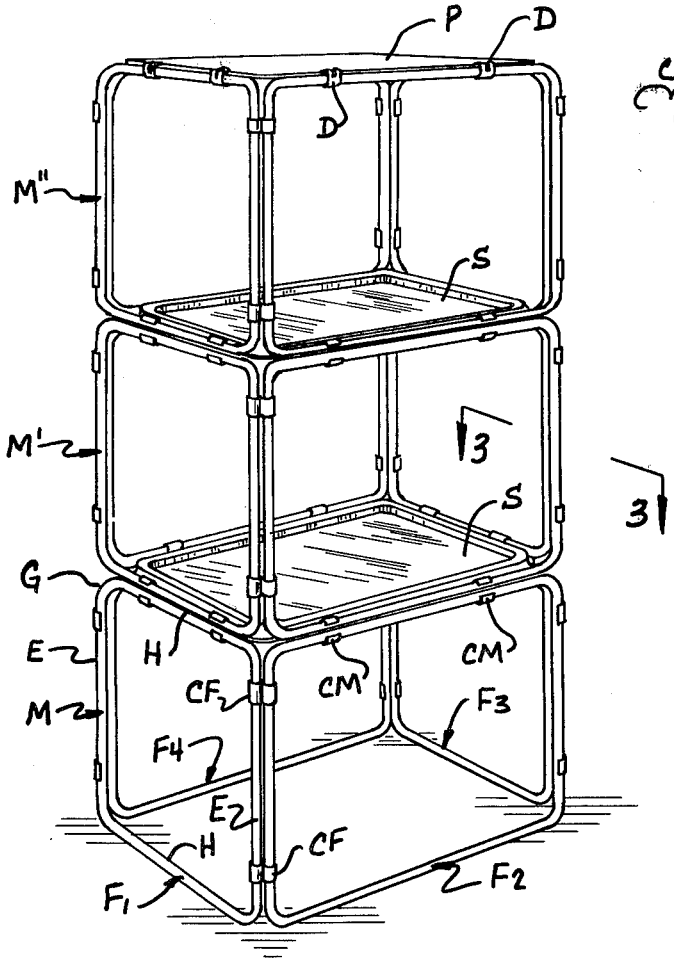
FIG. 1 is a perspective view of a stackable modular shelf apparatus embodying the present invention.
Figure 2:
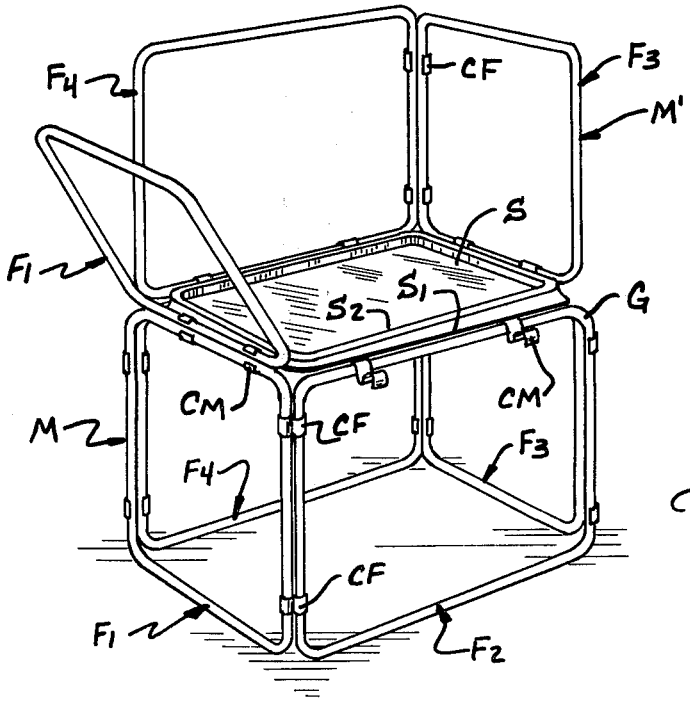
FIG. 2 is a fragmentary perspective view illustrating assembly of the stackable modular shelf apparatus.

The stackable modular shelf apparatus of the present invention includes at least two stackable frame modules and a shelf intermediately vertically adjacent frame modules in the stack. In FIG. 1, three stacked frame modules are shown including a lower frame module M; an intermediate frame module M′ and an upper frame assembly M″. A shelf is provided intermediate vertically adjacent frame modules and, as shown, intermediate shelves S are mounted between frame modules M and M′ and between frame modules M′ and M″. A top panel P is conveniently provided on the top of the upper frame module M″. The frame modules are of like construction and each includes a number of individual frames corresponding to the number of sides on the shelves. In the embodiment of FIGS. 1–4, the shelves have a generally rectangular configuration and four frames designated $F_1$–$F_4$ are provided in each frame module. The frames are of like construction but the frames used in each frame assembly may differ in length depending upon the length of the sides of the shelves.

Further, the frames used in different frame modules in the stacked shelf apparatus may differ in height. Each frame has a generally rectangular configuration with a pair of horizontal side members H connected to a pair of upright end members E at the corner G of the frame. The side and end members of each frame have a circular cross-section and are conveniently formed from tubular stock which is bent to form the arcuate corners G between the side members and end members. For example, the frames can be formed in two tubular sections each bent at two locations to a generally U-shaped configuration, and the U-shaped sections then joined as by welding at their ends to form a rectangular frame. Alternatively, the frames could be formed from four separate tubular sections with corner connectors joining the side and end members.

The frames of each frame module are disposed in upright planes along the sides of the intermediate shelves S with the upright end members E on adjacent ends of the frames in each frame module juxtaposed adjacent the corners of the shelf. Connectors CF described more fully hereinafter is provided for interconnecting the juxtaposed end members on the frame of each frame module.

When the frame modules are stacked one on top of the other as shown in FIG. 1, the horizontal side members H on the lower sides of each of the frames of the upper frame module are in juxtaposition to the side members H at the upper side of the respective one of the frames on the lower frame module. The intermediate shelves S each have a generally horizontal peripheral portion $S_1$ that is interposed between the juxtaposed sise members on stacked upper and lower frame modules, as best shown in FIGS. 3 and 4. The shelves are also advantageously formed with an upwardly extending rim $S_2$ that extends around the shelf inwardly of the peripheral portion $S_1$ to retain articles on the shelf and the rim $S_2$ is conveniently provided by forming a downwardly opening U-shaped channel in the shelf at a location inwardly of the peripheral portion $S_1$, as best shown in FIG. 4. Connectors CM are provided for interconnecting the upper and lower frame modules to each other and to the intermediate shelf. The connectors CM each comprise the unitary resilient clip member having a U-shaped intermediate portion $C_1$ and a pair of parallel semi-cylindrical end portions $C_2$ and $C_3$ integral with the legs of the U-shaped intermediate portion. The U-shaped intermediate portion of the clip member extends across the outer edge of the shelf S and opens inwardly on the shelf apparatus to receive the peripheral portion $S_1$ of the shelf, and the arcuate end portions $C_2$ and $C_3$ extend from the ends of the legs of the U-shaped intermediate portion and through an arc of greater than 180° and substantially less than 360°, for example through an arc of the order of 225° as shown in FIG. 4, with the open side of the semi-cylindrical end portions facing outwardly of the shelf apparatus. As also shown in FIG. 4, the web of the U-shaped intermediate portion $C_1$ is offset from a plane through the axes of the cylindrical portions $C_2$ and $C_3$, in a direction toward the open side of the end portions $C_2$ and $C_3$. The clip members preferably have a length which is short as compared to the length of the side members and may, for example, have a length of the order of one and one-half inches.

The juxtaposed upright members of the frames of each frame module are interconnected by clips CF and the clips CF preferably have the same configuration as the clips CM so as to minimize the number of different parts which must be made and used in assembly of the shelving apparatus and to also space the upright members of adjacent frame module apart a distance corresponding to the spacing between the vertically side members on stacked frame modules. As shown in FIG. 3, the clip members CF have a U-shaped intermediate portion $C_1$ and arcuate end portions $C_2$ and $C_3$ and the end portions embrace the upright members on adjacent frames to interconnect the same. Connectors CF are preferably arranged so that their U-shaped portion $C_1$ opens outwardly of the frame module with the semi-cylindrical end portions $C_2$ and $C_3$ opening inwardly of the frame module.

Panels such as indicated at P can be mounted at the top of the modular shelf apparatus and also alongside any of the frames $F_1$–$F_4$, in any module if desired. As shown in FIGS. 1, 8 and 9, a flat panel P overlies the top of the upper frame module M″ and a plurality of clips D are provided for clamping the panel to the adjacent frame members. As best shown in FIGS. 5–7, the clips D have a semi-cylindrical portion $D_1$ that extends through an arc of greater than 180°, for example an arc of the order of 225°, and the clip D is notched as shown at $D_2$ and bent to provide a first lip portion $D_3$ extending generally tangent to the semi-cylindrical portion $D_2$ and a second pair of lips $D_4$ that are offset from the lip $D_3$ a distance approximating the thickness of the panel P to receive the panel P therebetween.

The modular shelf apparatus shown in FIGS. 1–4 utilizes rectangular shelves and has a rectangular configuration with four frames $F_1$–$F_4$ in each module. However, the shelf apparatus is readily adapted for use with other multi-sided shelves, for example a triangular shelf such as shown at $T_1$ in FIG. 10 with three frames $F_1$–$F_3$ in each frame module or a trapezoidal shelf such as shown in $T_2$ in FIG. 11 with four frames $F_1$–$F_4$ in each frame module, but with frames $F_1$ and $F_3$ of unequal length. The number of frames used in each frame assembly will correspond to the number of sides the shelf and the length of the horizontal side members on each of the frames will be correlated with the length of the side on the shelf so that the upright end members on the frames will be juxtaposed adjacent the corners of the shelf for interconnection as by the clips CF.

From the foregoing it is thought that the construction and assembly of the stackable modular shelf apparatus will be readily apparent. The several frames such as $F_1$–$F_4$ of each frame module are interconnected by clips CF to form a multi-sided frame assembly. Connectors CM for interconnecting stacked frame modules and the intermediate shelf S can then be applied to the upper side members H on the frames of the lower frame module and the connectors CM swung out to a position as shown at the front side of the shelf apparatus in FIG. 2. A shelf S can then be positioned on top of the side member of the lower frame assembly and the clips swung inwardly to a position in which the U-shaped portions engage the peripheral portion $S_1$ of the shelf. Individual frames $F_1$–$F_4$ to form a superposed frame assembly can be individually positioned with their lower side members H into the clips CM on the lower frame assembly either before or after the connectors CM are moved inwardly into engagement with the peripheral portion of the shelf S, and the frames of the superposed frame assembly then interconnected by the clips CF. This can be continued until the entire stackable modular shelf apparatus is assembled. A top panel such as P can be applied to the shelf apparatus by the clips D. If desired, an additional panel or panels similar to P and of a size to overlie individual frames such as $F_1$–$F_4$, can be applied to the frames in upright planes and similarly connected to the respective frames by clips D.

The side and end members on the frames have a circular cross-section and the cylindrical end portions $C_2$ and $C_3$ of the connectors CM and CF engage the respective side and end members but permit axial turning therebetween. Thus, the clips hingedly interconnect the side and end members. This is advantageous in that it allows the clips to be pivoted out of and into a shelf engaging position during assembly of the modules and shelves as previously described, and also allows the frames to be positioned in different angular relation to each other to accommodate shelves of different configuration such as the rectangular shelf of FIG. 1 and the triangular and trapezoidal shelves of FIGS. 10 and 11. When the connectors CM are mounted to interconnect superposed frame modules and the intermediate shelf S, the intermediate shelf cannot be removed from a position between the interconnected frame modules and, moreover, the upper frame modules cannot be moved either laterally or vertically relative to a lower frame module or the shelf. Further, even though the upright end members on the frame modules are hingedly interconnected by the clips CF, the intermediate shelf when mounted in position between superposed frame modules positively holds the frames of each frame module against movement out of a polygonal configuration corresponding to the periphery of the shelf.

The embodiments of the invention in which an exclusive property or privilege is claimed are defined as follows:

1. A stackable modular shelf apparatus including at least two vertically stackable frame modules and at least one multi-sided intermediate shelf, each frame module including a number of individual frames corresponding to the number of sides on the intermediate shelf, each frame having a generally rectangular configuration with a pair of horizontal side members joined to a pair of upright end members at the corners of the frame, the frames of each frame module being arranged in upright planes along a respective side of the intermediate shelf with the upright end members on adjacent ends of the frames in each frame module juxtaposed adjacent the corners of the intermediate shelf, a plurality of first connectors engaging said juxtaposed end members to interconnect the individual frames of each frame module, one frame module being stacked on top of the other frame module with the horizontal side members on the lower sides of each of the frames of the upper frame module in juxtaposition with the upper side member of a respective frame on the lower frame module, the intermediate shelf having a generally horizontal peripheral portion interposed between the juxtaposed side members of the frames of the upper and lower frame modules, and a plurality of second connectors for interconnecting the upper and lower frame modules to each other and to the intermediate shelf, the second connectors each comprising a unitary resilient clip member having a pair of parallel semi-cylindrical end portions and an intermediate portion between the semi-cylindrical end portions and spacing the same apart a distance at least equal to the thickness on the horizontal peripheral portions of the intermediate shelf, said intermediate portion of the second connectors extending across the outer edge of the intermediate shelf and said semi-cylindrical end portions of the second connectors being disposed at opposite sides of the peripheral portion of the intermediate shelf and embracing the juxtaposed side members to interconnect frames on the upper and lower frame modules and to retain the intermediate shelf therebetween.

2. A stackable modular shelf apparatus according to claim 1 wherein the intermediate portion of the second connectors has a U-shaped configuration and opens inwardly of the shelf apparatus to receive the peripheral portion of the intermediate shelf, and said semi-cylindrical end portions of the second connectors have their open sides facing outwardly of the shelf apparatus.

3. A stackable modular shelf apparatus according to claim 2 wherein said side portions of the frames have a circular cross-section and said semi-cylindrical end portions of the second connectors rotatably receive said side portions.

4. A stackable modular shelf apparatus according to claim 1 wherein said frames each have arcuate corners.

5. A stackable modular shelf apparatus according to claim 1 wherein said intermediate shelf has a raised rim extending therearound inwardly of said horizontal peripheral portion.

6. A stackable modular shelf apparatus according to claim 1 wherein said intermediate shelf has a channel portion extending therearound inwardly of said horizontal peripheral portion.

7. A stackable modular shelf apparatus according to claim 1 wherein said first connectors have the same configuration as said second connectors.

8. A stackable modular shelf apparatus including at least two vertically stackable frame modules and at least one multi-sided intermediate shelf, each frame module including a number of individual frames corresponding to the number of sides on the intermediate shelf, each frame having a generally rectangular configuration with a pair of horizontal side members joined to a pair of upright end members at the corners of the frame, the frames of each frame module being arranged in upright planes along a respective side of the intermediate shelf with the upright end members on adjacent ends of the frames in each frame module juxtaposed adjacent the corners of the intermediate shelf, a plurality of first connectors engaging said juxtaposed end members to interconnect the individual frames of each frame module, one frame module being stacked on top of the other frame module with the horizontal side members on the lower sides of each of the frames of the upper frame module in juxtaposition with the upper side member of a respective frame on the lower frame module, the intermediate shelf having a generally horizontal peripheral portion interposed between the juxtaposed side members of the frames of the upper and lower frame modules, and a plurality of second connectors for interconnecting the upper and lower frame modules to each other and to the intermediate shelf, the second connectors each comprising a unitary resilient clip member having a U-shaped intermediate portion and a pair of parallel semi-cylindrical end portions integral with the legs of the U-shaped intermediate portion, the U-shaped intermediate portion of the clip member opening inwardly of the shelf apparatus and dimensioned to receive the peripheral portion of the intermediate shelf and the semi-cylindrical end portions of the clip member opening outwardly of the shelf apparatus and each dimensioned to receive a respective one of the juxtaposed side members therebetween.

* * * * *